US007424890B2

(12) United States Patent
Noel

(10) Patent No.: US 7,424,890 B2
(45) Date of Patent: Sep. 16, 2008

(54) ASSEMBLY COMPRISING TWO PACKAGING DEVICES CONNECTED BY A COUPLING MEMBER

(75) Inventor: Dominique Noel, Saint Maur des Fosses (FR)

(73) Assignee: L'Oreal, Paris (FR)

( * ) Notice: Subject to any disclaimer, the term of this patent is extended or adjusted under 35 U.S.C. 154(b) by 125 days.

(21) Appl. No.: 11/286,431

(22) Filed: Nov. 25, 2005

(65) Prior Publication Data

US 2006/0130868 A1 Jun. 22, 2006

Related U.S. Application Data

(60) Provisional application No. 60/633,446, filed on Dec. 7, 2004.

(30) Foreign Application Priority Data

Nov. 25, 2004 (FR) ..... 04 52753

(51) Int. Cl.
*A45D 33/00* (2006.01)
*A45D 40/26* (2006.01)

(52) U.S. Cl. ..... 132/294; 132/218

(58) Field of Classification Search ..... 132/294, 132/297, 314; 206/581; 401/118, 121, 122, 401/126–130; 220/4.07, 4.27, 23.4, 504; D28/78–84
See application file for complete search history.

(56) References Cited

U.S. PATENT DOCUMENTS 2,504,677 A * 4/1950 Fraser et al. ..... 132/314
D167,690 S * 9/1952 Hopgood ..... D28/86
2,691,184 A * 10/1954 Miller et al. ..... 401/129
3,613,697 A * 10/1971 Andrews ..... 401/102
3,690,777 A 9/1972 Costa
3,876,112 A * 4/1975 Kramer ..... 222/132
4,189,057 A * 2/1980 Morille ..... 220/23.4
4,603,784 A * 8/1986 Chang ..... 215/11.1
4,807,773 A 2/1989 Tsai
D300,269 S * 3/1989 Cassai et al. ..... D28/77
4,886,080 A 12/1989 Cole
D311,787 S * 10/1990 Cassai et al. ..... D28/77
D338,085 S * 8/1993 Cassai ..... D28/77
5,906,214 A 5/1999 Gueret
6,035,865 A * 3/2000 Krieger ..... 132/294
6,145,685 A * 11/2000 Dick ..... 220/23.88
6,464,418 B1 * 10/2002 Visser et al. ..... 401/34
6,637,963 B2 * 10/2003 Huang ..... 401/19
2002/0117422 A1 * 8/2002 Karoly ..... 206/581

* cited by examiner

*Primary Examiner*—Robyn Doan
*Assistant Examiner*—Rachel A. Running
(74) *Attorney, Agent, or Firm*—Oblon, Spivak, McClelland, Maier & Neustadt, P.C.

(57) ABSTRACT

A packaging assembly includes two packaging devices, with each device including a container able to contain a cosmetic and/or care product and a removable closure cap able to close off the container. In addition, a coupling member includes two housings communicating with one another and each opening via a respective opening. Each housing is able to at least partially accommodate one device. Further, the devices are configured to cooperate with one another so as to limit the respective clearances with which they are mounted in their respective housings.

47 Claims, 4 Drawing Sheets

ASSEMBLY COMPRISING TWO PACKAGING DEVICES CONNECTED BY A COUPLING MEMBER

CROSS-REFERENCE TO RELATED APPLICATIONS

This document claims priority to French Application No. 0452753, filed Nov. 25, 2004, and U.S. Provisional Application No. 60/633,446, filed Dec. 7, 2004, the entire contents of which are hereby incorporated by reference.

FIELD OF THE INVENTION

The invention relates to an assembly that includes a coupling member and two packaging devices for cosmetic products which are held respectively in this coupling member.

BACKGROUND OF THE INVENTION

Discussion of the Background

A "cosmetic product" is understood to mean a product as defined in Commission Directive 95/35 CE of 13 Jun. 1993.

U.S. Pat. No. 3,690,777 discloses an assembly which includes a double applicator device having a double closure member bearing, respectively, a first applicator member and a second applicator member axially opposed to one another. This double closure member is designed to close off, on the one hand, a first container with the first applicator member then being immersed in this first container and, on the other hand, to close off a second container with the second applicator member is then immersed.

Assemblies of this type are not ergonomic because when the user wishes to apply the product from the first container using the first applicator member, she is forced to hold in her hand the sub-unit consisting of the second container and of the double closure member. This sub-unit is heavy and bulky and may interfere with the precision of the desired makeup operation.

In fact, EP 1 378 188 discloses an assembly that includes at least two containers containing cosmetic or care products, each including a body and a removable closure cap and at least one elastically deformable coupling member capable of joining the two containers together as a continuation of one another. The coupling member is configured to at least partially accommodate the respective containers in such a way as to exhibit closure caps axially opposed to one another. Thus, applicator members mounted secured to the closure caps can be each handled independently of the containers.

However, these assemblies also present a problem because the containers are joined to one another end to end. These containers generally have an elongate shape because they have to have an internal cavity that is long enough to house the applicator member mounted at the end of a wand, which is relatively long in itself, secured to the closure cap. This is because it is necessary to provide a wand that is long enough that the region for holding, at the closure cap, is far enough away from the applicator member that the user's hands are not in her field of view, particularly when she is applying makeup to her eyelashes or lips.

With the containers arranged as a continuation of one another in such devices, they define a longitudinal axis of the assembly. With such arrangements, the length of assemblies of this type presents a problem because their longitudinal dimension is twice that of conventional packaging and applicator devices. As a result, handbags, makeup bags and the storage space generally provided in bathrooms are not necessarily suitable. In fact, these assemblies do not have commercially viable dimensions. Furthermore, as the containers are removably mounted in the coupling member, there is a risk that the user might forget to assemble them and suddenly find herself in possession of just one of the two containers, although the products that they may be precisely designed to be applied together to complement one another.

Shorter assemblies are disclosed in U.S. Pat. No. 4,886,080, in which the two containers are positioned side by side. In this case, the containers are arranged "head to tail" so that their respective closure caps are axially opposed. The two containers are formed as a single piece, and this presents a problem when the respective containers are being filled. Specifically, filling an assembly such as this entails numerous steps, particularly offering the first container up to a first supply head, then sealing it so that it can be turned through 180° so as to offer the second container up to a second supply head so that it, in turn, can be filled.

The filling rates for these assemblies are not satisfactory, particularly as a result of the operations respectively of filling and stoppering the two containers which cannot be done concomitantly. Finally, automating rotational movements is often more complicated to achieve than automating simple translational movements. In addition, rejects at the second supply head represent a substantial loss in value because, at this stage, the first container of these assemblies is already full. The method of filling these assemblies therefore can be more expensive than the method of assembling packaging devices in a coupling member.

SUMMARY OF THE INVENTION

It is an object of the invention to provide an assembly which includes two containers to be mounted in a coupling member in which the production rates for this type of assembly can be improved. In addition, the invention can provide an assembly the size of which is compatible with a handbag, a makeup bag or bathroom storage. Another benefit of an assembly according to the invention is to ensure that the containers are arranged non-removably in the coupling member, so that there is no risk of them becoming separated from one another.

According to a preferred example of the invention, an assembly is provided which includes two packaging devices, with each device including a container able to contain a cosmetic and/or care product and a removable closure cap able to close off the container. In addition, a coupling member includes two housings communicating with one another, with each opening via a respective opening, and with each housing being able to at least partially accommodate one device. Further, the devices are configured to cooperate with one another so as to limit the respective clearances with which they are mounted in their respective housings.

As another example of the invention, an assembly is provided having a longitudinal axis, with the assembly including a first device for packaging a first cosmetic product, with the first device including a first container in which a first applicator is immersed. A second device is provided for packaging a second cosmetic product with the second device including a second container in which a second applicator is immersed. The first and second devices are coupled to one another in such a way that one of the applicators is orientated in a first direction and the other of the applicators is orientated in a second direction which is more or less opposite to the first. The assembly includes first and second ends along the longitudinal axis which are configured in such a way that it cannot rest in a stable fashion on a flat surface via either one of the first and second ends. The expression "more or less the opposite" as used herein means parallel to the first direction, or making an angle of at most 45° with respect to the first. Preferably the angle with respect to the first direction is at most 20° and more preferably still at most 10°.

One advantage afforded by such a configuration is that it forces the assembly to be stored flat so that the product respectively contained in each container do not accumulate at the opening of one of the containers.

Advantageously, axially opposed ends of the assembly are bevelled so that the projection of the center of mass of the assembly along an axis perpendicular to one of the bevelled ends is not defined within the outline of this end.

As a preference, the closure caps respectively exhibit or are provided at the axially opposed ends of the assembly.

According to a preferred embodiment, the coupling member includes an arrangement for collaborating with the first device and the second device in order to limit their respective clearances in the coupling member.

Advantageously, according to one example, the coupling member includes a first arrangement, for example in the form of a first elastically deformable tab, able to hold the first device in the first housing. This first tab may extend from a periphery of the first opening. For example, the first tab can run parallel to an axis of insertion of the first device through this first opening. Advantageously, the container of the first device can include, for example, a lug or protrusion able to cooperate by butting against the first arrangement. The lug, if appropriate, deforms the first tab as it is inserted into the first housing. In order to cooperate with the first device, the container of the second device can include a step able to cooperate with the lug in such a way as to keep the lug between this step and the first arrangement, particularly between this step and an edge of the first tab.

Advantageously, and further by way of example, the coupling member by way of a reciprocal arrangement can include a second arrangement, for example in the form of a second elastically deformable tab, which is able to hold the second device in the second housing. For example, a lug or protrusion belonging to the container of the second device can also be axially immobilized between this second arrangement, an edge of this second tab if appropriate and a step belonging to the container of the first device.

As a preference, by way of example, the openings have a cross section that does not exhibit symmetry of revolution (or about an axis), with each complementing a cross section of one of the devices. Thus, each opening is specially configured to accept one of the devices. For example, the openings can exhibit a plane of symmetry and the devices may also exhibit a plane of symmetry.

As a preference, and also by way of example, a device may be inserted in a special way into its housing in such a way that the cooperation between the devices may be guaranteed as long as the arrangements respectively provided on each of the devices are correctly offered up one relative to the other so that they can cooperate, and thus so as to limit their clearance in the coupling member.

By way of example, according to one advantageous embodiment, the containers are identical to one another so that the costs of manufacturing the containers can be reduced. In addition, these containers can be filled using the same filling head. The same is true when the closure caps are identical to one another. Another advantageous aspect by arranging or configuring the coupling member to have a center of symmetry. Thus, inserting each of the devices into its respective housing can be done in a simpler way.

According to one particular embodiment, by way of example, the containers of the devices are inserted in the coupling member in such a way that at least one of the devices has a neck protruding beyond one of the openings.

As a preference, the coupling member is obtained by overmoulding, with walls delimiting the second housing being overmoulded over walls delimiting the first housing. Alternatively, this coupling member may be obtained by two-shot injection moulding. Thus, the walls delimiting each of the housings may be produced in different colors so as to provide a visual color code allowing the user to determine which of the products she wishes to apply.

Advantageously, by way of example, the first housing includes, on its internal periphery, at least one rib able to cooperate with the external periphery of the first device so as to limit its lateral clearance within the coupling member, with this clearance being considered perpendicular to an axis of insertion of the device into its housing.

For example, the closure cap of the first device can include at least one fin extending from its internal periphery, with this fin being configured to prevent the closure caps from nesting one inside the other before they are mounted on their respective container.

Advantageously, at least one of the devices includes an applicator member secured to either the container or the cap. In this case, at least one of the devices may house an applicator member secured to the corresponding closure cap, for example with the applicator member being held in the closure cap by snap-fastening.

For example, an applicator member can be mounted at the end of a wand held in the closure cap in such a way that, in a closed position, sealed contact is established between this wand and a sealing arrangement associated with the container.

As a preference, at least one of the containers can include a wringing-out feature, for example a wringing-out feature made of an elastically deformable material, for example an elastomer. In particular, the wringing-out can be arranged according to the type of product and/or to the type of applicator member provided in the corresponding device.

According to a preferred embodiment, and by way of example, each device includes an applicator member, and these applicator members may differ from one another. For example, one of the applicator members can be a brush with bristles, while the other of the applicator members can be a comb.

According to a preferred embodiment, for example, the openings can be axially opposed. In particular, an axis of insertion of the first device into the coupling member may be distinct from an axis of insertion of the second device into this coupling member. In particular, the two axes of insertion may be parallel to one another.

According to a preferred embodiment, the two devices are positioned side by side, at least partially contiguous, in the coupling member so as to be able to cooperate with one another at least in the part where they are contiguous. "Contiguous" as used herein means that the respective projections of each of the two devices onto a longitudinal axis of the coupling member along an axis of projection perpendicular to this longitudinal axis are at least partially superposed.

In particular, by way of example, the assembly can include an arrangement for indexing the position of the closure member relative to the coupling member in the closed position. Thus, the profile of the assembly may be chosen such that there is continuity between the external periphery of the closure cap and the external periphery of the coupling member.

This arrangement also makes it possible to use these closure caps to hide the injection points of the coupling member.

By way of example, the containers of the assembly according to the invention can contain different products, preferably distinct make-up products, which are such that a first product contained in the first device is to be applied prior to applying a second product contained in the second device.

As should be apparent, the invention can provide a number of advantageous features and benefits. It is to be understood that, in practicing the invention, an embodiment can be constructed to include one or more features or benefits of embodiments disclosed herein but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The invention will be better understood upon reading the description which follows and upon examining the accompanying figures. These figures are given by way of nonlimiting examples of the invention in which.

DETAILED DESCRIPTION OF THE PREFERRED EMBODIMENTS

Figure 1:
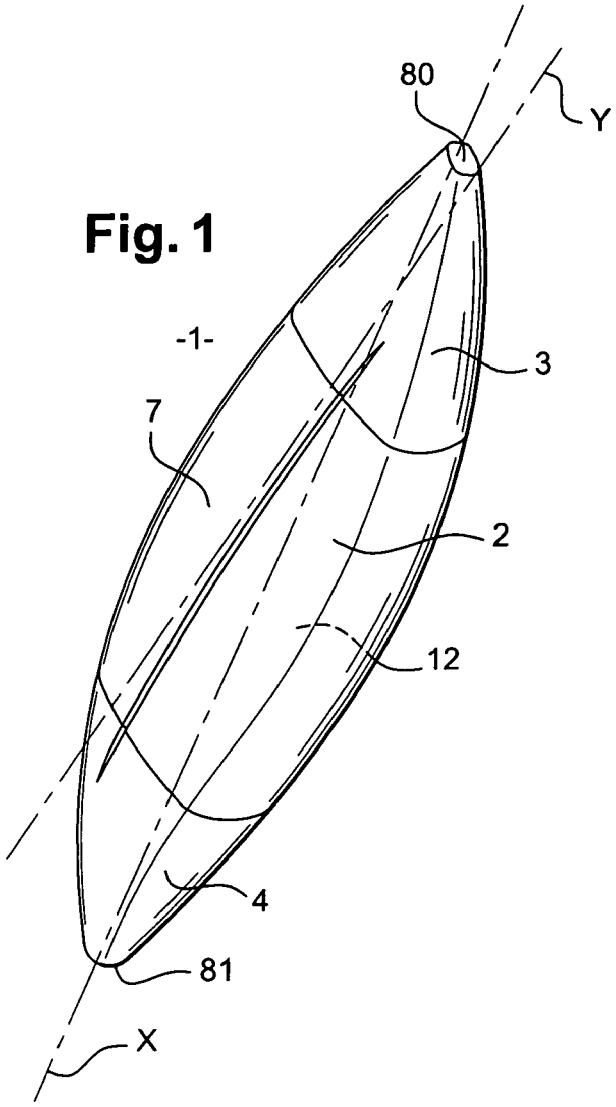
FIG. 1 is a perspective view of an assembly according to the invention.
Figure 4:
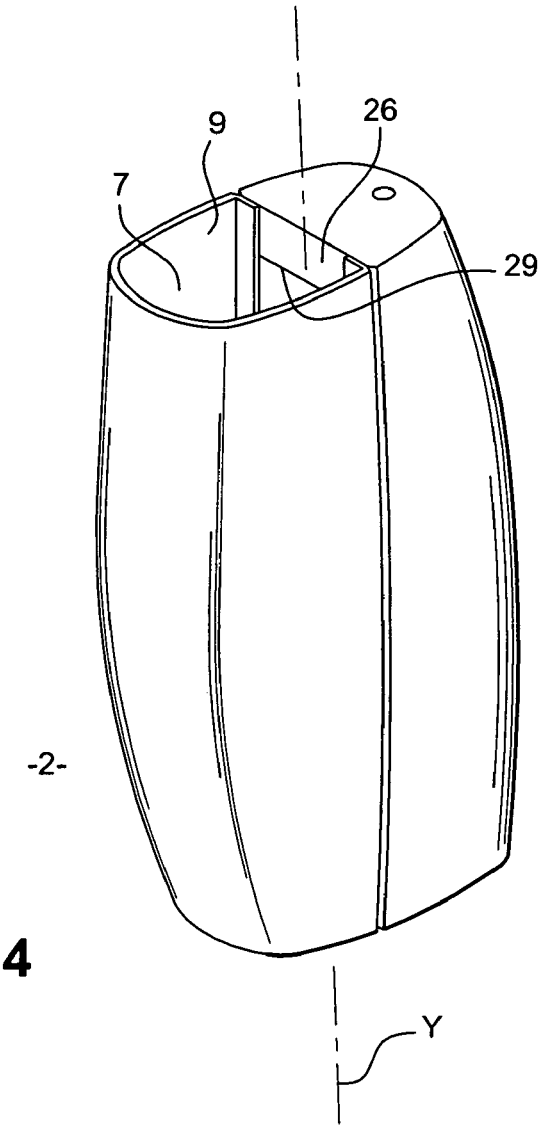
FIG. 4 is a perspective view of an empty coupling member of an assembly according to the invention.

FIG. 1 shows an example of an assembly 1 according to the invention in an assembled position, with a coupling member 2 being positioned between the respective closure caps 3 and 4 of containers, not visible, of the devices held in this assembly 1. In the assembled position, the assembly 1 exhibits a longitudinal axis X. This longitudinal axis X passes respectively through each of the closure caps 3 and 4.

Figure 2:
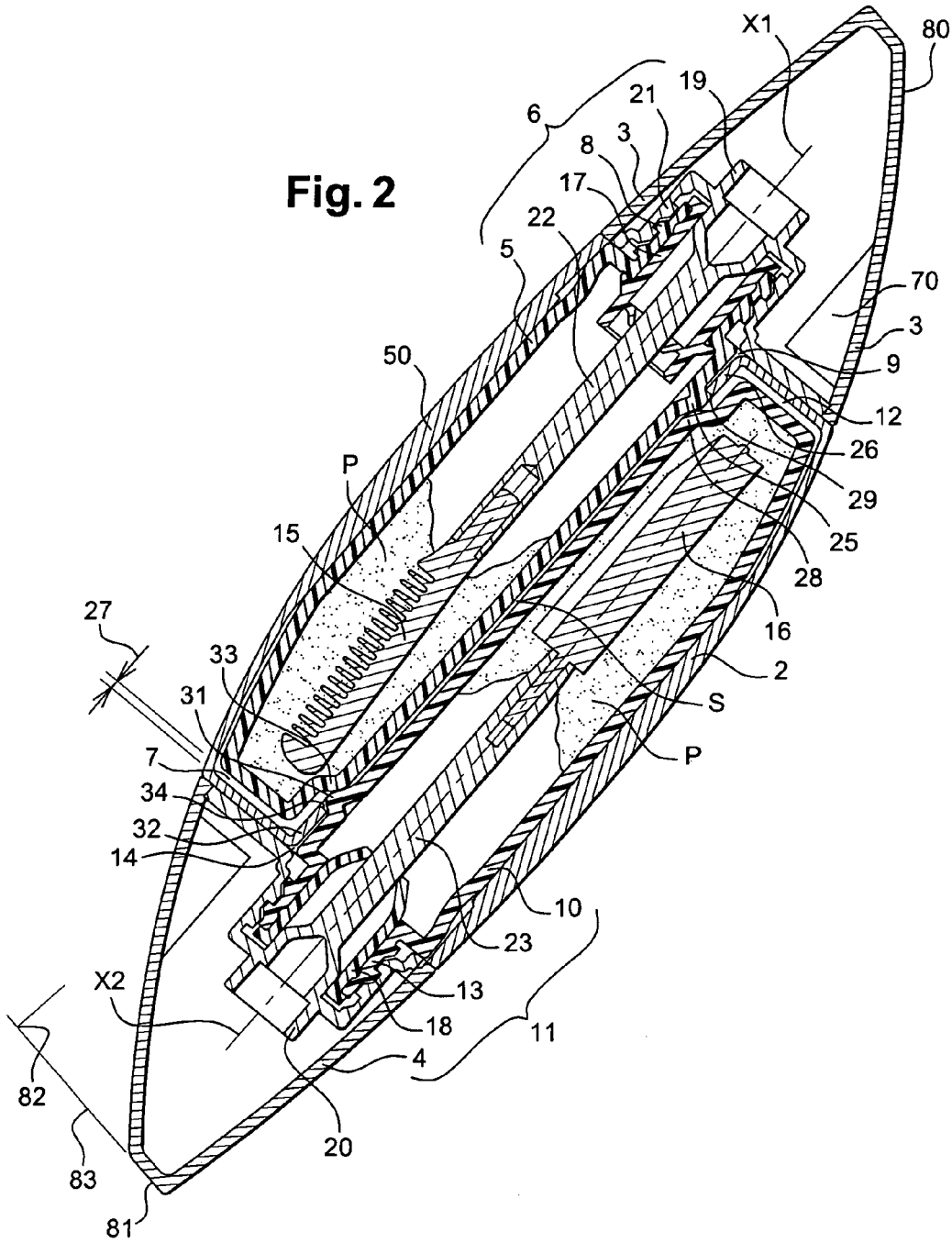
FIG. 2 is a view in longitudinal section of an assembly according to the invention.

According to the view of the assembly 1, in longitudinal section as shown in FIG. 2, the first closure cap 3 closes off a container 5 of a first packaging device 6. In this example, the container 5 is positioned partially inside a first housing 7 delimited by the coupling member 2, such that a neck 8 of the container 5 protrudes beyond an opening 9 of the first housing 7.

By way of a reciprocal arrangement in this example, the second closure cap 4 closes off a container 10 of a second packaging device 11, with the container 10 being positioned partially inside a second housing 12 delimited by the coupling member 2 in such a way that a neck 13 of the container 10 protrudes beyond an opening 14 of the said second housing 12.

The openings 9 and 14 are axially opposed relative to a longitudinal axis Y of the coupling member 2. Preferably, the openings 9 and 14 are not superposed in the illustrated example, considering projections of these openings onto a plane perpendicular to the longitudinal axis Y, along this longitudinal axis Y. The devices 6 and 11 are mounted "top to tail" in the coupling member 2.

Each container 5 or 10 contains, as can be seen in particular in FIG. 2, a product P. The containers 5 and 10, in the example considered, contain different products P but it would not constitute a departure from the scope of the present invention if the products P were identical and if, for example, only the applicator members provided in these devices 6 or 11 differed. These applicator members contained in the devices 6 or 11 may or may not be identical. By way of example, the applicators may differ through their texture and/or their shape and/or their nature.

Specifically, in the example depicted, a first applicator member 15 of the first device 6 is a comb, obtained for example by molding and designed to be immersed in the product contained in the first container 5. This comb 15 includes for example two rows of teeth, one row being staggered with respect to the other, with these two rows being arranged in such a way that the teeth of one row lie in a plane at an acute angle to the plane of the teeth of the other of the rows. In FIG. 2, since the applicator member 15 is in section on a mid-plane, only the teeth of one of the rows are visible.

According to this same example of an embodiment, the second applicator member 16 of the second device 11 is a brush obtained, for example, by twisting together two metal wires between which a layer of bristles is positioned, with this brush 16 being designed to be immersed in the product contained in the second container 10. In particular, by way of example, in the arrangement of FIGS. 2 and 3, the brush 16 can have four longitudinal grooves so that a section transverse to an axis formed by two iron wires of this brush is in the shape of a cross.

Each respective neck 8 and 13 may, as appropriate, serve as a support for a wringing-out or wiping feature 17 and 18 respectively, which can include, for example, a tube fitted with one or more internal scraping skirts, so as to even out and limit the amount of product held by the applicator member before makeup starts to be applied. The wringing-out features 17 and 18 are, for example, held inside their respective neck by a single- or double-snap fastening.

In the illustrated example, these applicator members 15 and 16 are each mounted on an applicator holder 19 and 20 respectively. In particular, the comb 15 is mounted on an applicator holder 19 itself held fixedly in the first closure cap 3 while the brush 16 is mounted on an applicator holder 20 held fixedly in the second closure cap 4. Each applicator holder 19 or 20 includes a mounting skirt 21 configured to be screwed onto the neck 8, or 13 as appropriate, and a wand 22 and 23 respectively, on the end of which the applicator member 15 or 16 respectively is provided. Each wand 22 and 23 may be configured in such a way as to provide a sealed closure of the device around the entire internal periphery of the wringing-out feature 17 or 18.

Each closure cap 3 or 4 acts as a member for holding the applicator member 15 or 16 respectively immersed in the product P inside the closed container. Preferably, by way of example, the applicator holders 19 and 20 are held in their closure cap by snap fastening. To this end, each applicator holder includes at least one, and preferably two, rims 60 standing up on a plate 61 able to block off the hollow formed by the closure cap, with this rim 60 being intended to cooperate by snap-fastening with a complementary rail or groove (not depicted) provided on the internal periphery of the closure cap. As a preference the wands 22 and 23 stand at right angles to their respective plate 61.

In the example depicted, the containers 5 and 10 have identical exterior shapes, but it would not constitute a departure from the scope of the present invention if the containers had different shapes.

Figure 3:
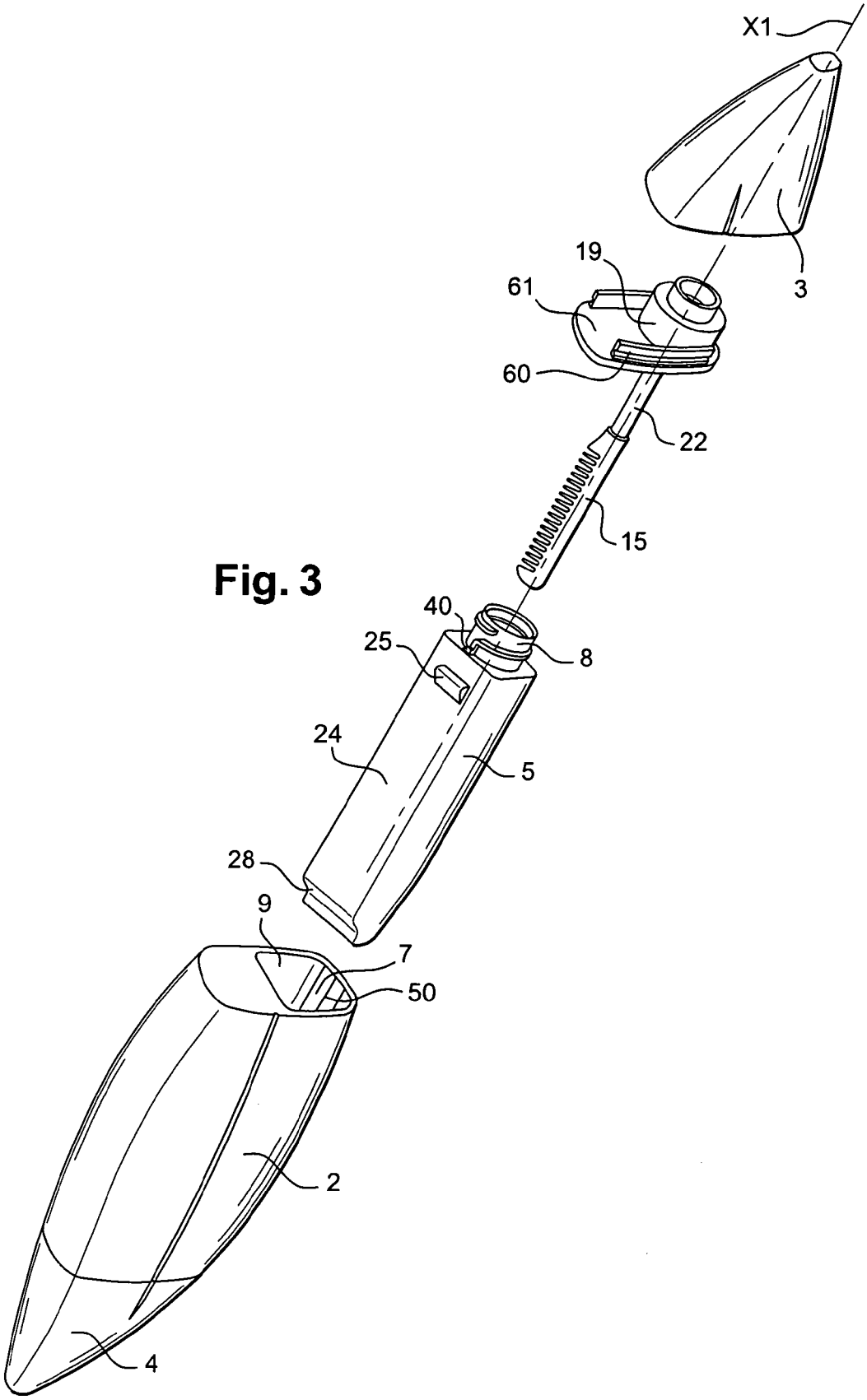
FIG. 3 is a partially exploded view of an assembly according to the invention.
Figure 5:
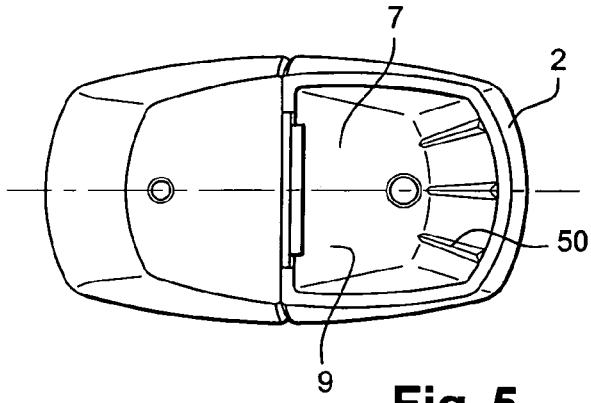
FIG. 5 is a view from above of an empty coupling member of an assembly according to the invention.
Figure 6:
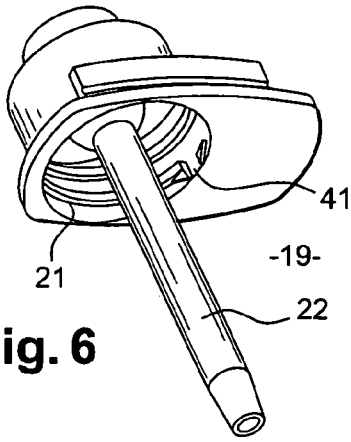
FIG. 6 is a perspective view of an applicator holder intended to be mounted in a closure cap according to the invention.
Figure 7:
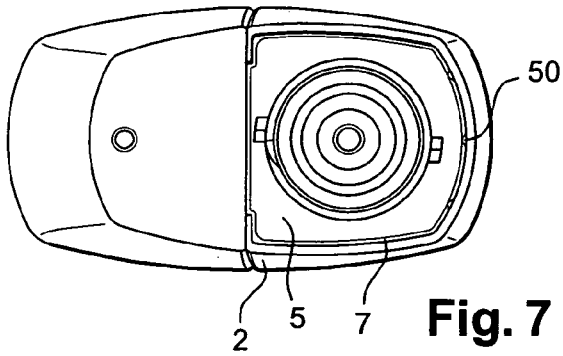
FIG. 7 is a view from above of an assembly according to the invention when a closure cap is detached.
Figure 8:
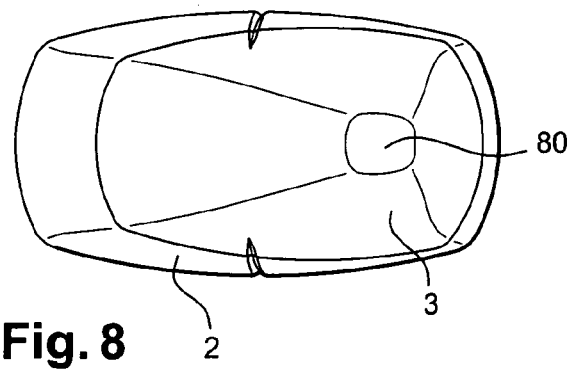
FIG. 8 is a view from above of an axial end of an assembly according to the invention.

From the exploded view of FIG. 3, the first device 6 is shown in exploded view, out of its first housing 7. One face 24 of the external periphery of the container 5 exhibits a first arrangement or part 25, in this example in the form of a lug 25, intended to cooperate with a first counterpart arrangement or a counterpart part 26, in this example in the form of a first elastically deformable tab 26, extending from the periphery of the opening 9.

In particular, the opening 9 is defined in a plane and this tab 26 runs more or less at right angles to this plane, inside the first housing 7. The lug 25 runs transversely to a longitudinal axis X1 of the container 5 which corresponds more or less to an axis of insertion of the device 6 in the housing 7, the face 24 being more or less parallel to this longitudinal axis X1. For example, the axis of insertion X1 is perpendicular to the plane in which the opening 9 is defined. As a preference, this lug 25 has a chamfered periphery to make it easier to insert in the housing 7.

In this example, at the time of insertion of the container 5 into the housing 7, when the lug 25 comes into contact with the tab 26, the latter is temporarily deformed until the lug 25 lies underneath this tab 26. The container 5 is then able to float a little inside the housing 7 inasmuch as the housing is designed to be slightly deeper than the axial length of that part of the container 5 intended to be located in this first housing 7. Along the axis X1, more or less parallel to the longitudinal axis Y of the coupling member 2, the axial clearance 27 is, for example, of the order of at least 0.2 mm, in particular at least 0.5 mm and preferably of the order of 0.65 millimeters, so as to tolerate dimensional variations in manufacture.

By contrast, inasmuch as the closure cap 3 is designed to cooperate only with the neck 8 in this example, without coming into contact with the coupling member 2, in order to limit the clearance of the device 6 relative to this coupling member 2, cooperation between this device 6 and the second device 11 is envisaged. In particular, this cooperation occurs at a communication between the housings 7 and 12. Thus, the containers 5 and 10 respectively are able respectively to come into contact with one another in a region common to the two housings 7 and 12 which region is defined inside the coupling member 2.

Specifically, in order to immobilize the container 5 axially in the housing 7, the container 10 comprises a lateral step 28 exhibited by a wall of this second container 10 facing the face 24 so that this lateral step 28 comes to bear against a first side of the lug 25 so as to push a second side of this lug 25 against an edge 29 of the tab 26.

This system for immobilizing the container 5 is more or less operational if the position of the second container 10 inside the coupling member 2 can itself be guaranteed, particularly as far as the position of the lateral step 28 is concerned. To achieve this, the dimensions of the housing 12 may be tailored to the dimensions of this second container 10. However, as is the case with the first container 5, the second container 10 is designed to have a degree of axial float in its housing 12, along its axis of insertion X2 in the absence of the first container 5. Cooperation of the containers 5 and 10 with one another allows them to be more or less immobilized in the coupling member 2.

For this purpose, the second container 10 has a face 30 such as 24 where there is a second arrangement or second part, such as lug 31, intended to cooperate with a second counterpart arrangement or counterpart part 32 of the coupling member 2, for example in the form of a second elastically deformable tab 32 running from the periphery of the opening 14 of the second housing 12. In particular, this opening 14 is defined in a plane, preferably parallel to the plane of the opening 9 and this second tab 32 stands more or less at right angles to this plane, inside the second housing 12.

The lug 31 runs transversely to a longitudinal axis X2 of the second container 10 which corresponds more or less to an axis of insertion X2 of the second device 11 in the second housing 12, with the face 30 being more or less parallel to this longitudinal axis X2. For example, the axis of insertion X2 is perpendicular to the plane in which the opening 14 is defined. The axis X1 is preferably parallel to and distinct from the axis of insertion X2. As a preference, the axes X1 and X2 are parallel to the longitudinal axis Y of the coupling member 2. As a variant, the axes X1 and X2 may be secant and, for example, between them form an acute angle smaller than 45°, for example smaller than 20° and preferably smaller than 10°. In any case, the clearances for mounting the containers 5 and 10 in their respective housings can lead to a variability of, for example, less than 5° of the axes X1 and X2 relative to the longitudinal axis Y.

As a preference, this lug 31 also has a chamfered periphery to facilitate its insertion into the housing 12. Furthermore, the face 24 of the first device 6 also includes a lateral step 33 such as 28 intended to cooperate with this lug 31 so as to confine it between this lateral step 33 and an edge 34 of the tab 32.

Preferably, the lateral step 28 or 33 includes an inclined plane intended to lead onto a portion of greater or lesser magnitude depending on the dimensional variations of manufacture, with an inclined plane exhibited by the external periphery of the corresponding chamfered lug 31 or 25 as appropriate. The plane is considered to be inclined relative to the axis X1 of insertion of the first device 6.

Thus, the lateral step 28 in the face 30 of the second container 10 cooperates with the lug 25 of the first container 5 to keep it in a fixed axial position along the longitudinal axis Y or, at least, to minimize its axial clearance in this first housing 7, while the lateral step 33 in the face 24 of the first container 5 cooperates with the lug 31 of the second container 10 to keep it too in a fixed axial position along the longitudinal axis Y, or at least to minimize its axial clearance in the second housing 12.

Without considering the lateral steps 28 and 33 and the lugs 25 and 31 respectively, the faces 24 and 30 are also more or less parallel to one another in the illustrated example so that they can be slid along one another as the devices 6 and 11 are being inserted.

The housings 7 and 12 are adjacent and more or less defined on either side of the longitudinal axis Y. In particular, when considering an axial projection onto the axis Y along an axis perpendicular to this longitudinal axis Y, the projection of the first device 6 is superimposed at least partially on the projection of the second device 11. In particular, in the illustrated example the necks of the devices are not superposed on part of the other device when such a projection is performed.

The necks 8 and 13 respectively protrude beyond the openings 9 and 14 by a more or less predictable length, and the closure caps 3 and 4 can be screwed on correctly. The expression "screwed on correctly" means that the sealing of the closure by the closure cap can be achieved or assured, while at the same time allowing alignment between the external peripheries of the coupling member and of these closure caps.

In particular, the closure caps are respectively designed to cooperate with a screw thread provided on the external periphery of the neck. In order to open and close the devices, turning the closure cap preferably does not lead to any turning of the device to which it is attached inasmuch as the external periphery of the container has a non-circular cross section in the illustrated example, and inasmuch as the internal periphery of its housing and of its opening is of homothetic cross section, and barely slightly larger than that of the container.

Preferably, the containers have a plane of symmetry and can be inserted into their respective housing in just one way. Thus, as an arrangement for indexing the position of the cap relative to its container are planned in the invention, with the arrangement reliably able to index the position of the closure cap relative to the coupling member and thus provide the desired appearance of the assembly 1.

In particular, the indexing or positioning arrangement can include an end stop 40 exhibited on the neck 8 and intended to cooperate with a return 41 exhibited on the interior periphery of the mounting skirt 21. In the assembled position the end stop 40 is immobilized between two edges of the return 41 to immobilize the closed position. As a preference, these indexing or positioning arrangements are duplicated and arranged opposite one another around the neck.

On the other hand, in order to avoid radial clearance, perpendicular to the longitudinal axis Y, the internal periphery of the housings 7 and 12 include steps, for example in the form of ribs 50, preferably longitudinal ones so as to cooperate with the external periphery of the containers. As a preference, the ribs bear against an opposite face of the container to the face 24, or the opposite face to the face 30, as appropriate. Thus, the presence of the ribs 50 encourages cooperation between the containers and thus alleviates the effects of any dimensional variations transverse to the axis Y.

For example, the coupling member 2, the containers 5 and 10, the closure caps 3 and 4, the applicator holders 19 and 20 may be made of a thermoplastic, for example of a polyolefin material.

In particular, the coupling member 2 can be made of polypropylene, for example. Preferably, it is obtained by overmoulding, with the walls of the first housing 7 being produced using a first colorant incorporated into their mass, whereas the walls of the second housing 12 are preferably produced incorporating a colorant of visibly different color from the first colorant into the mass of the material overmoulded over the walls of the first housing.

By way of example, the containers 5 and 10 can be made of polyamide and are able to contain about 5 ml of product P.

Also by way of example, the wringing-out or wiping feature 17 intended to cooperate with the comb-form applicator member 15 can be made of nitrile, whereas the wringing-out feature 18 intended to cooperate with the brush-form applicator member 16 can be made of low density polyethylene. Where the applicator members 15 and 16 are different, the wringing-out features 17 and 18 can also be different.

The closure caps 3 and 4 can be made of polypropylene, for example, preferably in such a way that one of the caps is made of the same material as the material used for the walls of the first housing 7, while the other of the caps can be made from the same material as is used for the walls of the second housing 12. Preferably, these closure caps include, as visible in FIG. 2, an internal fin 70 and preferably two internal fins such as 70. These internal fins 70 make it possible to prevent the closure caps from being stacked up inadvertently on one another before they are fitted with their respective applicator holder. They are therefore easier to transport along the production line.

The applicator holders 19 and 20 can be made of poly-oxymethylene (POM).

When viewed from the outside, the assembly 1 exhibits longitudinal walls, stretching between the closure caps 3 and 4, which are more or less convex. The closure caps 3 and 4 respectively therefore exhibit the axial ends 80 and 81 of the assembly 1 along the longitudinal axis X. The longitudinal axis X is preferably secant to the longitudinal axis Y of the coupling member 2.

The axial ends 80 and 81 are not located along the longitudinal axis Y in the preferred example illustrated. In addition, they are configured in such a way that the center of gravity S of the assembly 1 cannot lie in line with these ends 80 or 81 in a stable position. Specifically, the projection 82 of the center of gravity S along an axis perpendicular to a surface 83 in which the end 81 is defined does not fall inside the outline of this end 81 on the surface 83 (FIG. 2). The other end 80 is designed in the same way relative to this center of gravity S. As a result, the position when the assembly 1 is resting on a horizontal plane via one of its axial ends 80 and 81 is unstable.

In particular, in the illustrated example each closure cap 3 or 4 has an exterior surface in the overall shape of a dome, flattened at its top. The flattened portions form the axial ends 80 and 81. As a preference, these flattened portions define a surface such as 83 which is inclined by a little more than 90° relative to the longitudinal axis Y. These surfaces such as 83 are also inclined by a little more than 90° relative to the longitudinal axis X.

Apart from the internal specifics of the devices 6 and 11, particularly with regard to the applicator members, to the applicator holders and to the wringing-out features, the assembly 1 has a center of symmetry more or less superimposed on the centre of gravity S when the amount of product contained in the containers and when the respective weights of the applicator members, the applicator holders and the wringing-out features are more or less identical.

The products P contained in the containers 5 and 10 are preferably mascaras, for example with different colors, textures and/or natures. As a variant, one of the containers can contain a mascara, while the other of the containers can contain an eyeshadow in a color that complements the mascara. As another variant, one of the containers can contain a product intended to be applied to the lips while the other of the containers can contain a complementing blusher.

Throughout the description, the dimensional values are given to within 10% of their nominal value, unless other range limits are specified.

Throughout the description, the expressions such as "comprising a," "comprising one," "having one" or "including one" are to be considered to be synonymous with "comprising at least a" and "comprising at least one", unless specified to the contrary. Similarly, expressions such as "comprising two" (or higher numbers), etc., are to be considered to be synonymous with "comprising at least two" (or higher numbers), unless specified to the contrary.

In the foregoing detailed description reference is made to preferred embodiments of the invention. It is evident that variants thereto can be proposed without departing from the invention as claimed here below. It is therefore to be understood that, within the scope of the appended claims, the invention may be practiced otherwise than as specifically described herein.

What is claimed as new and desired to be secured by Letters Patent of the United States is:

1. An assembly comprising:

a) first and second packaging devices, each device comprising a container able to contain a cosmetic and/or care product and a removable closure cap able to close off the said container;

b) a coupling member comprising first and second housings communicating with one another through an opening between the first and second housings, wherein the first and second housings open via respective first and second openings, and wherein each housing is able to at least partially accommodate one device; and wherein the first and second devices cooperate directly with one another through the opening so as to limit the respective clearances with which they are mounted in their respective housings, and wherein an axis of insertion (X1) of the first device into the coupling member is distinct from an axis of insertion (X2) of the second device into the coupling member.

2. An assembly according to claim 1, wherein the assembly comprises a longitudinal axis (X), and wherein axially opposed ends of the assembly are bevelled so that the projection of the center of mass (S) of the assembly along an axis perpendicular to one of the bevelled ends is not defined within the outline of said one of the beveled ends.

3. An assembly according to claim 1, wherein the closure caps define axially opposed ends of the assembly.

4. An assembly according to claim 1, wherein the coupling member comprises means for collaborating with the first device and the second device in order to limit their respective clearances in the coupling member.

5. An assembly according to claim 1, wherein the coupling member comprises a first means to hold the first device in the first housing.

6. An assembly according to claim 5, wherein the first means includes a first tab.

7. An assembly according to claim 6, wherein the first tab extends from a periphery of the first opening.

8. An assembly according to claim 6, wherein the container of the first device comprises a first lug able to cooperate by butting against the first tab and wherein the first lug deforms the first tab as the first device is inserted into the first housing.

9. An assembly according to claim 7, wherein the first tab extends parallel to the axis of insertion (X1) of the first device through the first opening.

10. An assembly according to claim 1, wherein the openings have a cross section that is not axi-symmetric, with each complementing a cross section of one of the devices.

11. An assembly according to claim 10, wherein the openings are each symmetrical about a plane.

12. An assembly according to claim 11, wherein the first and second devices are each symmetrical about a plane.

13. An assembly according to claim 1, wherein the containers and the closure caps of the devices are identical to one another.

14. An assembly according to claim 1, wherein at least one of the devices has a neck protruding beyond one of the openings.

15. An assembly according to claim 1, wherein the coupling member is obtained by overmoulding or two-shot injection moulding, with walls delimiting the second housing being overmoulded over walls delimiting the first housing.

16. An assembly according to claim 1, wherein the first housing comprises, on its internal periphery, at least one rib able to cooperate with an external periphery of the first device so as to limit its radial clearance within the coupling member.

17. An assembly according to claim 1, wherein the assembly includes a center of symmetry.

18. An assembly according to claim 1, wherein at least one of the devices includes an applicator member secured to either the container or the cap.

19. An assembly according to claim 18, wherein at least one of the containers includes a wringing-out arrangement for the applicator.

20. An assembly according to claim 1, wherein at least one of the devices houses an applicator member secured to the corresponding closure cap.

21. An assembly according to claim 20, wherein the applicator member is snap-fastened to the closure cap.

22. An assembly according to claim 20, wherein the applicator member is mounted at the end of a wand held in the closure cap in such a way that, in a closed position, sealed contact is established between the wand and a sealing means exhibited by the container.

23. An assembly according to claim 1, wherein each device comprises an applicator member.

24. An assembly according to claim 23, wherein the applicator members are different.

25. An assembly according to claim 24, wherein one of the applicator members is a brush and the other of the applicator members is a comb.

26. An assembly according to claim 1, wherein the first and second openings open at axially opposite ends of the assembly.

27. An assembly according to claim 1, wherein the two axes of insertion are parallel to one another.

28. An assembly according to claim 1, wherein the first and second devices are positioned side by side, at least partially contiguous, in the coupling member.

29. An assembly according to claim 1, further including means for indexing the position of the closure cap relative to the coupling member in the closed position.

30. An assembly according to claim 1, wherein the containers contain different products, which are such that a first product contained in the first device is to be applied prior to applying a second product contained in the second device.

31. An assembly according to claim 30, wherein the products are make-up products.

32. An assembly according to claim 31, wherein the products are eye make-up products.

33. An assembly according to claim 32, wherein an applicator is associated with each of the first and second devices.

34. An assembly according to claim 33, wherein the applicators are respectively inserted into the respective first and second devices at opposite axial ends of the assembly and in substantially opposite axial directions.

35. An assembly according to claim 1, wherein axial movement of the first device is limited in a first axial direction by the second device and in a second axial direction opposite to said first by said coupling member.

36. An assembly as claimed in claim 35, wherein said first and second openings respectively open at opposite axial ends of said assembly.

37. An assembly according to claim 36, wherein first and second applicators are respectively associated with each of said first and second devices, and wherein a direction of removal of said first applicator from said first device is substantially opposite to a direction of removal of said second applicator from said second device.

38. An assembly according to claim 1, wherein the first and second devices cooperate directly with one another through the opening by coming into contact with each other.

39. An assembly according to claim 38, wherein each of the first and second devices include a neck, a base, and a sidewall arranged between the neck and the base, and wherein a portion of the sidewall of the first device comes into contact with a portion of the sidewall of the second device.

40. An assembly according to claim 38, wherein a side face of an external periphery of the first device extends substantially parallel to a longitudinal axis of the first device, and wherein the side face of the first device includes a projection that comes into contact with the second device.

41. An assembly according to claim 1, wherein the first and second devices are respectively arranged in the first and second housings of the coupling member such that a longitudinal axis of the first device is offset with respect to a longitudinal axis of the second device.

42. An assembly according to claim 1, wherein said first and second openings respectively open at opposite axial ends of said assembly, and wherein the first and second devices are respectively arranged in the first and second housings of the coupling member such that a longitudinal axis of the first device is not co-linear with a longitudinal axis of the second device.

43. An assembly comprising:

a) first and second packaging devices, each device comprising a container able to contain a cosmetic and/or care product and a removable closure cap able to close off the said container;

b) a coupling member comprising first and second housings communicating with one another, wherein the first and second housings open via respective first and second openings, and wherein each housing is able to at least partially accommodate one device; and wherein the first and second devices are configured to cooperate with one another so as to limit the respective clearances with which they are mounted in their respective housings, wherein the coupling member comprises a first means to hold the first device in the first housing, wherein the first means includes a first tab, wherein the container of the first device comprises a first lug able to cooperate by butting against the first tab, wherein the first lug deforms the first tab as the first device is inserted into the first housing, and wherein the container of the second device comprises a step which cooperates with the first lug in such a way as to keep the first lug between this step and an edge of the first tab.

44. An assembly according to claim 43, wherein the coupling member comprises a second tab which is elastically deformable and which cooperates with a second lug of the container of the second device, wherein the second lug is axially immobilized between an edge of this second tab and a step of the container of the first device.

45. An assembly comprising:

a) first and second packaging devices, each device comprising a container able to contain a cosmetic and/or care product and a removable closure cap able to close off the said container;

b) a coupling member comprising first and second housings communicating with one another, wherein the first and second housings open via respective first and second openings, and wherein each housing is able to at least partially accommodate one device; and wherein the first and second devices are configured to cooperate with one another so as to limit the respective clearances with which they are mounted in their respective housings, wherein axial movement of the first device is limited in a first axial direction by the second device and in a second axial direction opposite to said first by said coupling member, and wherein said first device includes a first protrusion which engages with said second device to limit movement in said first axial direction and which engages said coupling member to limit movement in said second axial direction.

46. An assembly according to claim 45, wherein said second device includes a second protrusion which limits axial movement of said second device by engagement with said first device in one axial direction and by engagement with said coupling member in another axial direction opposite to said one axial direction.

47. An assembly according to claim 46, wherein said first and second openings respectively open at opposite axial ends of said assembly.

* * * * *